US007586506B2

(12) United States Patent
Park et al.

(10) Patent No.: US 7,586,506 B2
(45) Date of Patent: Sep. 8, 2009

(54) LIGHT EMITTING DISPLAY DEVICE AND METHOD OF DRIVING THE SAME

(75) Inventors: Sung Cheon Park, Kyunggi-do (KR); Choon Yul Oh, Kyunggi-do (KR)

(73) Assignee: Samsung Mobile Display Co., Ltd., Yongin, Gyunggi-Do (KR)

( * ) Notice: Subject to any disclaimer, the term of this patent is extended or adjusted under 35 U.S.C. 154(b) by 675 days.

(21) Appl. No.: 11/215,015

(22) Filed: Aug. 31, 2005

(65) Prior Publication Data

US 2006/0061531 A1 Mar. 23, 2006

(30) Foreign Application Priority Data

Sep. 22, 2004 (KR) ..... 10-2004-0075820

(51) Int. Cl.
*G09G 5/02* (2006.01)

(52) U.S. Cl. ..... 345/694

(58) Field of Classification Search ..... 345/204, 345/76, 82, 87, 694
See application file for complete search history.

(56) References Cited

U.S. PATENT DOCUMENTS 5,422,658 A * 6/1995 Kawaguchi et al. ..... 345/213
5,654,777 A 8/1997 Shin
6,404,410 B1 * 6/2002 Shirae ..... 345/55
6,768,485 B2 * 7/2004 Awamoto et al. ..... 345/204
2001/0022565 A1 * 9/2001 Kimura ..... 345/82
2003/0006978 A1 * 1/2003 Fujiyoshi ..... 345/204
2004/0233185 A1 * 11/2004 Hashimoto et al. ..... 345/204
2005/0225521 A1 * 10/2005 Leo et al. ..... 345/87

FOREIGN PATENT DOCUMENTS

JP 2003-122293 4/2003
KR 1999-0033180 5/1999
KR 10-0394886 8/2003

* cited by examiner

*Primary Examiner*—Amr Awad
*Assistant Examiner*—Stephen G Sherman
(74) *Attorney, Agent, or Firm*—Robert E. Bushnell, Esq.

(57) ABSTRACT

A video signal processing method and a delta-structured display device using the same where video signals are rearranged in a logical structure such as a programmable logic chip. The video signal processing method includes receiving sequentially first line video signals and second line video signals, each having a plurality of video signals having red sub video signals, green sub video signals, and blue sub video signals, extracting alternately one of the red sub video signals, the green sub video signals, and the blue sub video signals for at least two successive video signals of the first line video signals and storing the extracted signals into a memory as the first line delta video signal, and alternately extracting one of the red sub video signals, the green sub video signals, and the blue sub video signals for at least two successive video signals of the second line video signals and storing the extracted signals into a memory as the first line delta video signals.

28 Claims, 13 Drawing Sheets

LIGHT EMITTING DISPLAY DEVICE AND METHOD OF DRIVING THE SAME

CLAIM OF PRIORITY

This application makes reference to, incorporates the same herein, and claims all benefits accruing under 35 U.S.C. §119 from an application for LIGHT EMITTING DISPLAY DEVICE AND METHOD OF DRIVING THE SAME earlier filed in the Korean Intellectual Property Office on Sep. 22, 2004 and thereby duly assigned Serial No. 2004-75820.

BACKGROUND OF THE INVENTION

1. Field of the Invention

The present invention pertains to a video signal processing method and a display device using the same and, more specifically, to a video signal processing method and a delta-structured display device that can be used in a small display where input video signals are rearranged for use in a delta pixel structure in a programmable logic circuit.

2. Discussion of Related Art

In general, a display device uses video signals to display predetermined images. The video signals indicate information about an image for display on a screen. Such video signals are typically input to a controller of the display device from the external device, and then transmitted to each pixel through a driving portion according to the control of the controller.

A display device generally has a stripe pixel structure or a delta pixel structure. The stripe pixel structure is a structure where pixels, each having a red pixel, a green pixel and a blue pixel are arranged in a straight line. The delta pixel structure (hereinafter, referred to as a 'delta-structure') is a structure where pixels, each having a red pixel, a green pixel and a blue pixel, are arranged approximately in a triangle across two lines. A delta-structure display device will be described below.

Generally, curves and moving images are more effectively and efficiently displayed on a display that uses a delta structure instead of the stripe structure. However, in order to process video signals for a delta structure display effectively, a large memory and a high-end central processing unit (CPU) are needed. This is problematical for small displays as small displays do not and can not always contain large memories or CPUs. Therefore, what is needed is a method and an apparatus for displaying video signals having a delta structure that can easily be implemented in small-sized displays.

SUMMARY OF THE INVENTION

It is therefore an object of the present invention to provide an improved method for displaying delta structure video data on a display.

It is also an object of the present invention to provide an improved display device that displays images using the delta structure.

It is further an object of the present invention to provide a method of displaying video data that can be applied to a small display that uses a delta-type structure.

It is yet another object of the present invention to provide a design for a small display that inverts and displays video signals according to a delta-type structure.

It is still an object of the present invention to provide a video signal processing method that can be applied to a small delta-structured display device absent a driver integrated circuit (IC).

It is also an object of the present invention to provide a video signal processing method capable of optimizing a driving portion in a driver IC in a delta-structure display device.

It is yet an object of the present invention to provide a delta-structure display device employing the novel video signal processing method.

These and other objects can be achieved by a method of processing a video signal for a light emitting display device that includes receiving sequentially first line video signals and second line video signals, each having a plurality of sub video signals such as a red sub video signal, a green sub video signal, and a blue sub video signal, extracting alternately one of the red sub video signals, the green sub video signals, and the blue sub video signals from at least two successive video signals of the first line video signals and storing the extracted signal into a memory as the first line delta video signals, and extracting alternately one of the red sub video signals, the green sub video signals, and the blue sub video signals from at least two successive video signals of the second line video signals and storing the extracted signal into the memory as the second line delta video signals.

The storing of the extracted second line delta video signals into the memory can include reading the extracted first line delta video signals from the memory followed by storing the extracted first line delta video signals into the memory. In addition, storing the extracted second line delta video signals into the memory can include reading the extracted first line delta video signals from a first region of the memory while recording the extracted first line delta video signals into a second region of the memory. In addition, the memory can include a line memory having a storage capacity of at least one horizontal line.

The method can further include sequentially providing the first line delta video signals and the second line delta video signals to a data driving portion. Here, the first line delta video signals and the second line delta video signals can be provided to the data drive circuit by delaying by a predetermined clock cycle the second line delta video signals preceded by the predetermined clock cycle to the first line delta video signals such that a start position of the second line delta video signals is aligned to a start position of the first line delta video signals.

The method can further include providing the first line delta video signals to data lines in an image display portion during a first horizontal period where first scanning signals are applied to first scanning lines, and providing the second line delta video signals to the data lines during a second horizontal period following the first horizontal period where second scanning signals are applied to second scanning lines.

The sequentially receiving the first and second line video signals can include sequentially receiving odd signals and even signals of the first line video signals and odd signals and even signals of the second line video signals, respectively, in parallel.

The extracting the first and second line delta video signals can include extracting the first and second line delta video signals from even signals of the first line video signals and odd signals of the second line video signals, respectively.

The extracting the first and second line delta video signals can include extracting the first and second line delta video signals by inverting an order of extracting the odd signals and the even signals, based on a direction of shifting signals by a shift register in a scan driver.

The extracting the first and second line delta video signals can include extracting the first and second line delta video signals by inverting an order of extracting the red sub video signal, the green sub video signal, and the blue sub video signals from the odd signals of the first line video signals and the even signals of the second line video signals, based on a data signal applying direction between a first direction extending in a scanning direction and a second direction opposite to the first direction.

Another aspect of the present invention is to provide a display device that includes a scan driver adapted to supply scanning signals to a plurality of scanning lines a data driver adapted to supply data signals to a plurality of data lines a plurality of pixels arranged in a delta, each pixel comprises a light emitting diode electrically connected to one of the scanning lines and one of the data lines and a controller adapted to control the scanning signals and the data signals supplied to the plurality of pixels, wherein the controller also being adapted to sequentially receive first line video signals and second line video signals, each having a plurality of video signals having red sub video signals, green sub video signals, and blue sub video signals, alternately extract one of the red sub video signals, the green sub video signals, and the blue sub video signals for at least two video signals of the first line video signals and stores the extracted signals into a memory as the first line delta video signals, alternately extract one of the red sub video signals, the green sub video signals, and the blue sub video signals for at least two video signals of the second line video signals and stores the extracted signals into a memory as the first line delta video signals, and sequentially supply the first line delta video signals and the second line delta video signals to the data driver. The controller can include a low voltage differential signal (LVDS) interface adapted to receive odd signals and even signals of the first line video signals and odd signals and even signals of the second line video signals, respectively, in parallel.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
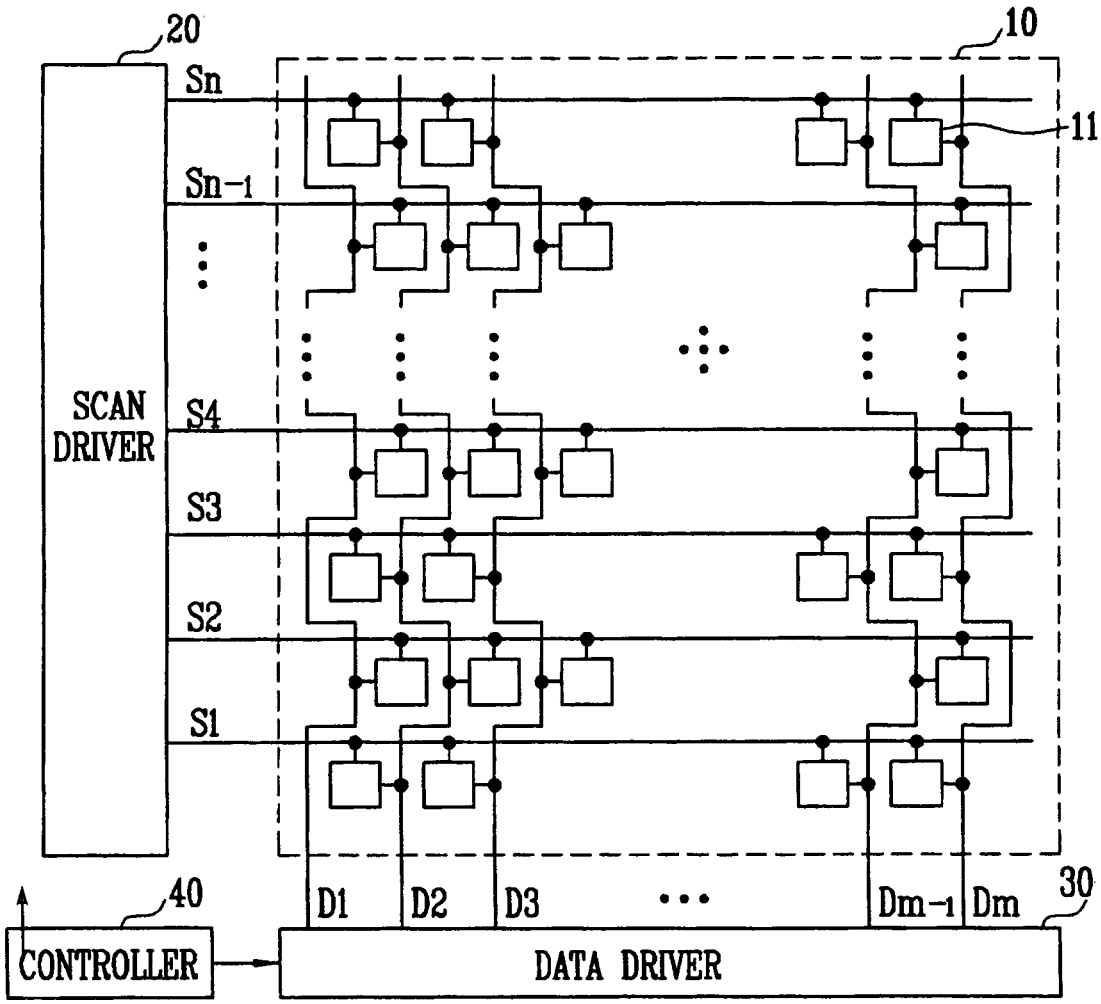
FIG. 1 is a view of a delta-structured display device.
Figure 2:
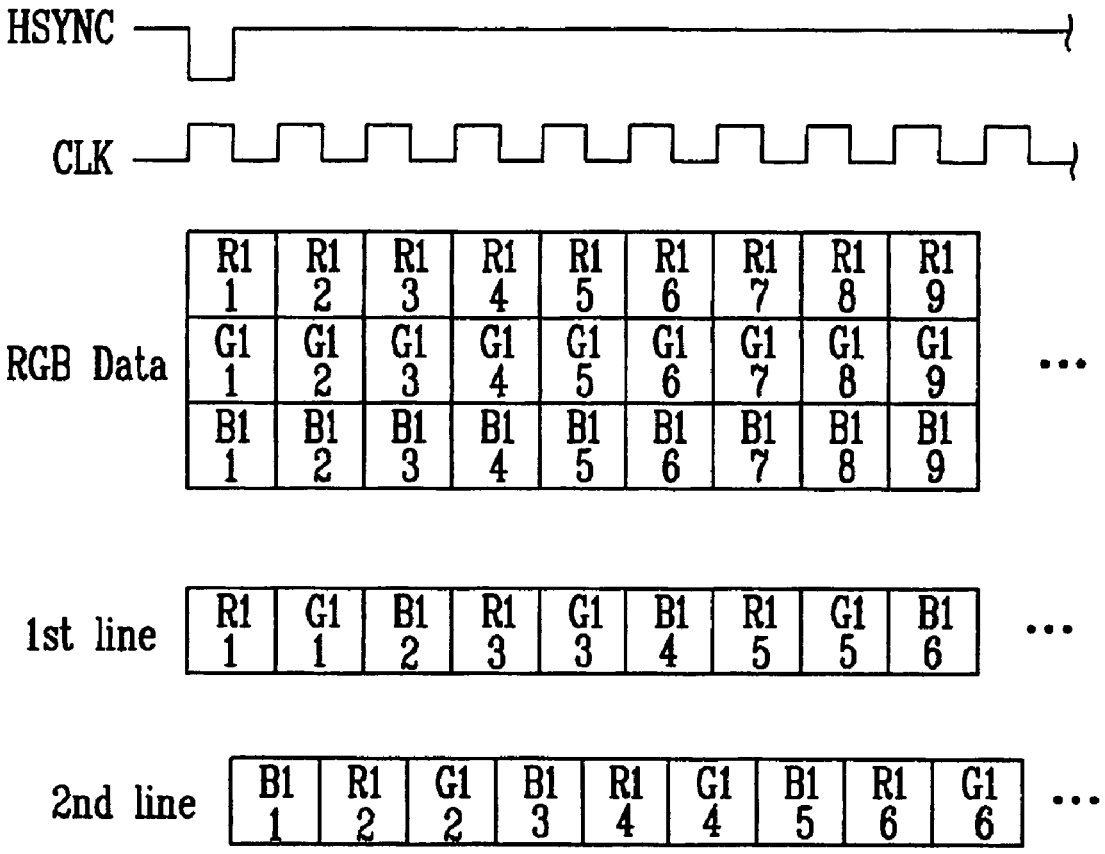
FIG. 2 is a view of a video signal processing method in the delta-structured display device.

Turning now to the figures, FIG. 1 is a view of a delta-structured display device and FIG. 2 is a view of video signals supplied to the display device of FIG. 1. Referring to FIG. 1, the delta-structured display device includes an image display portion 10, a scan driver 20, a data driver 30, and a controller 40. Further, the delta-structured display device includes a plurality of pixels 11 arranged in the delta-structure within the image display portion 10. Strictly speaking, each pixel 11 in display portion 10 includes to one of the red, green, and blue pixels.

The image display portion 10 includes a plurality of scanning lines S1, S2, S3, S4, . . . , Sn-1, and Sn for transferring scanning signals, a plurality of data lines D1, D2, D3, . . . , and Dm-1, Dm for transferring data signals, and a plurality of pixels 11 electrically connected to the scanning lines and the data lines. The pixels 11 include, for example, a light emitting diode (not illustrated) and a pixel circuit (not illustrated) for controlling the light emitting diode.

The scan driver 20 supplies scanning signals to the scanning lines S1, S2, S3, S4, . . . , Sn-1, and Sn using signals output from a shift register (not illustrated). For example, the scan driving circuit 20 supplies scanning signals to each pixel 11 in a single scanning scheme or a sequential scanning scheme. The data driver 30 converts the video signals transmitted from the controller 40 into the data signals appropriate to the pixel structure, and then, sequentially supplies the data signals to data lines D1, D2, D3, . . . , Dm-1, and Dm in the image display portion 10 by each one horizontal line.

The controller 40 generates a control signal and a clock signal to control the scan driver 20 and the data driver 30. Here, the control signal includes a vertical sync signal, a horizontal sync signal, and a start pulse. In addition, the controller 40 stores the video signals to be input to a frame memory (not illustrated), etc., and supplies the video signals to the data driver 30 by each one frame. Here, the controller 40 handles the video signals as first video signals of odd horizontal lines and second video signals of even horizontal lines such that the video signals are suitable for the delta structure. For example, as illustrated in FIG. 2, the controller 40 converts RGB video signals of RGB Data, sequentially input from the external device (not illustrated) into first video signals of the odd horizontal lines (or signals corresponding to a first line) and second video signals of the even horizontal lines (or signals corresponding to a second line) in synchronization with the horizontal sync signal HSYNC and a clock signal CLK such that the RGB data is suitable for the delta structure.

Displaying a curve or a moving image is best accomplished using a delta-structured display device as opposed to using a stripe pixel structure. For this reason, delta-structured pixel arrangements are preferably used over a stripe-type pixel arrangement. However, the delta-structured display device requires that the input video signals conform to the delta structure, thus requiring complex manipulations of the input RGB video signals to transform them into odd horizontal lines and even horizontal lines while changing the order thereof. Therefore, a large memory and a high-speed operation device such as a CPU needs to be mounted in most delta-structured display devices. This results in an increase of the manufacturing costs of the display device and also an increase in the weight and the size of the display device.

Also, in a small display devices, a control circuit unit arranged as a programmable logic chip type such as a field programmable gate array is used instead of the high-speed operation device such as a CPU. When the small display device uses the delta structure, the small delta-structured display device needs to perform a relatively large amount of operations, but the small display device does not have a high-speed CPU operation device or a large capacity memory to effectively and efficiently process the delta structured video signals. As a result, it is difficult to apply the delta-structured display device in a small display device.

Figure 3:
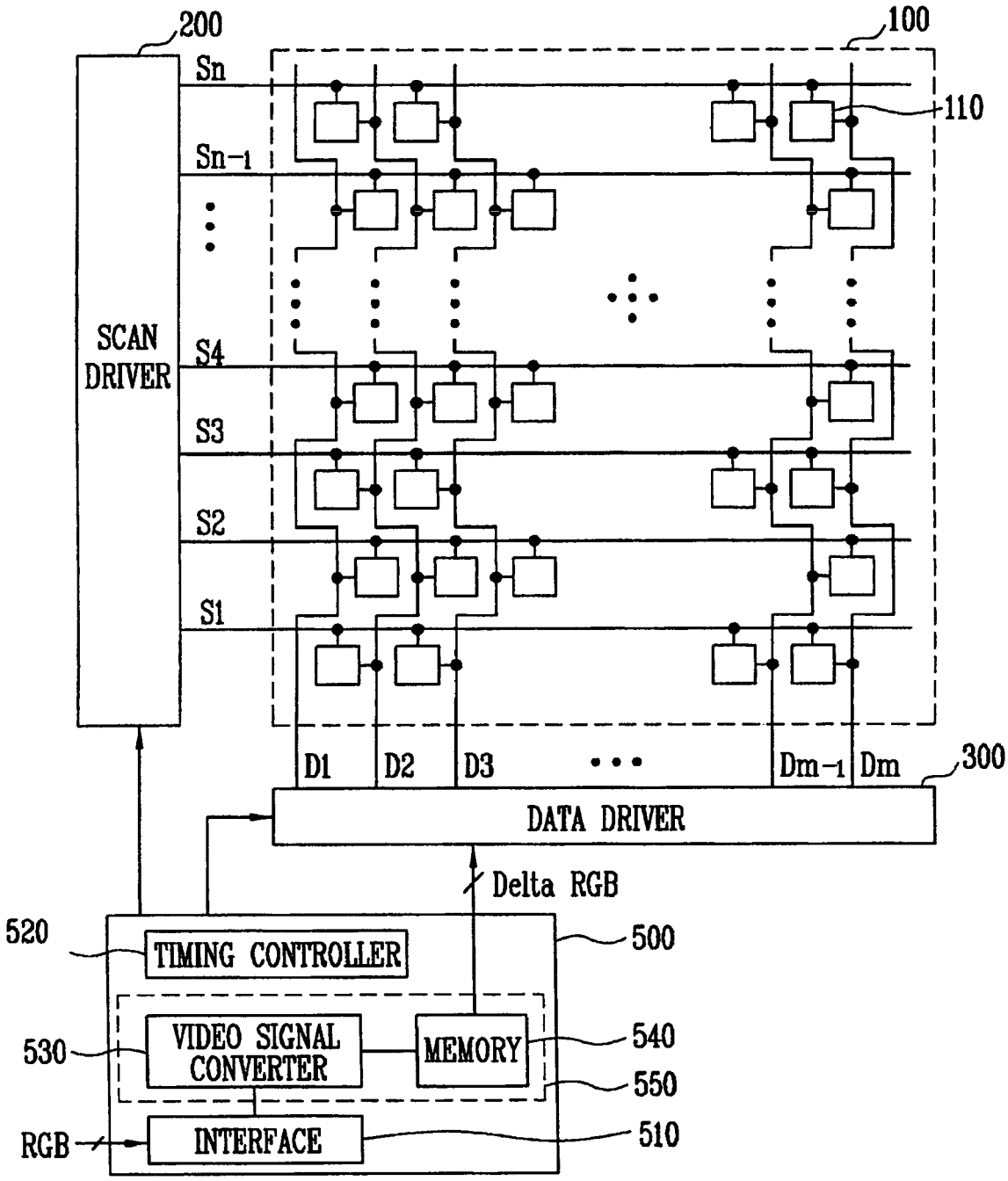
FIG. 3 is a view of a delta-structured display device according to an embodiment of the present invention.

Turning now to FIG. 3, FIG. 3 is a view of a delta-structured display device according to an embodiment of the present invention. In FIG. 3, the delta-structured display device is formed in a structure where data signals for displaying the same color are applied to one signal line. Referring to FIG. 3, the delta-structured display device according to an embodiment of the present invention processes and displays the input video signals RGB appropriate for the delta structure. As illustrated in FIG. 3, the delta-structured display device includes an image display portion 100, a scan driver 200, a data driver 300, and a controller 500.

The image display portion 100 includes a plurality of scanning lines S1, S2, S3, S4, . . . , Sn-1, and Sn for transferring scanning signals, and a plurality of data lines D1, D2, D3, . . . , Dm-1, and Dm for transferring data signals, and a plurality of pixels 110 electrically connected to the scanning lines and data lines, respectively. Here, red, green, and blue pixels 110 arranged in two scanning lines forms a delta pixel that displays a unit pixel having a delta structure.

Figure 4:
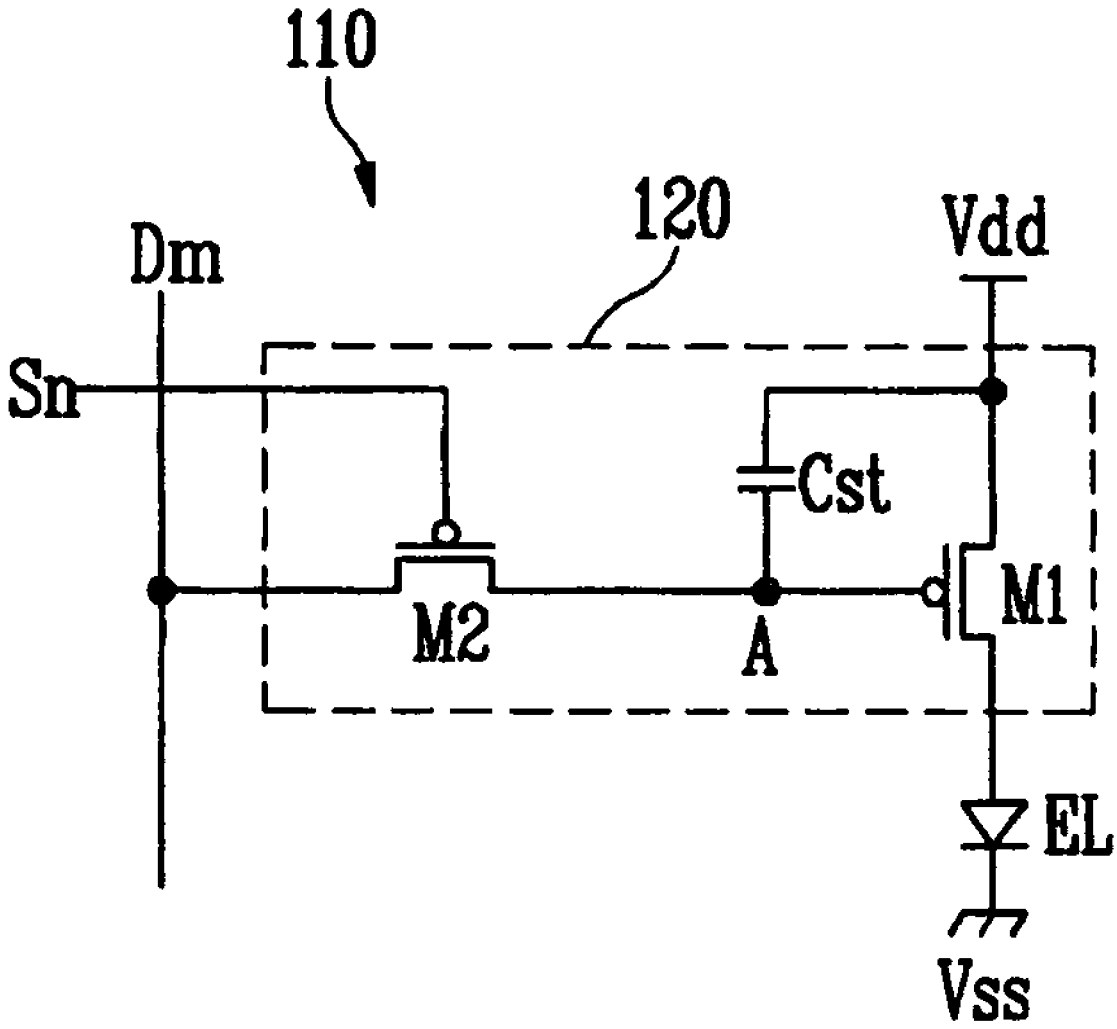
FIG. 4 is a view of a circuit diagram of a pixel circuit of a delta-structured display device of FIG. 3.

In the display of FIG. 3, each pixel 110 includes a light emitting diode (LED) where predetermined voltages Vdd and Vss are applied at both ends and a pixel circuit 120 that controls the LED. As illustrated in FIG. 4, the pixel circuit 120 includes a second transistor M2 for transferring data signals of the data line Dm to a gate of the first transistor M1 in response to the scanning signal of the scanning line Sn, and a capacitor Cst for storing a voltage corresponding to the data signals transferred through the second transistor M2, the first transistor M1 acts as a predetermined current source corresponding to the voltage stored in the capacitor Cst. The LED emits light having a predetermined color and intensity in response to the current flowing from the first transistor M1.

The scan driver 200 uses signals output from a shift register (not illustrated) to supply scanning signals to the scanning lines S1, S2, S3, S4, . . . , Sn-1, and Sn. For example, the scan driver 200 supplies the scanning signal to each pixel 110 in any one scanning scheme among a single scanning scheme, a sequential scanning scheme, a dual scanning scheme, an interfaced scanning scheme, and other scanning schemes. Here, each scanning scheme according to the present embodiment can be appropriately adjusted and applied to be suitable for the delta structure.

The data driver 300 supplies data signals or delta video signals to each pixel 110 such that the pixels 110 arranged in the delta structure can display the predetermined images, respectively. For example, after the data driver 300 converts the video signals transferred from the controller 500 into the data signal, it sequentially supplies the data signals having an amount of one horizontal line to each data line D1, D2, D3, . . . , Dm-1, and Dm in the image display portion 100.

Figure 5:
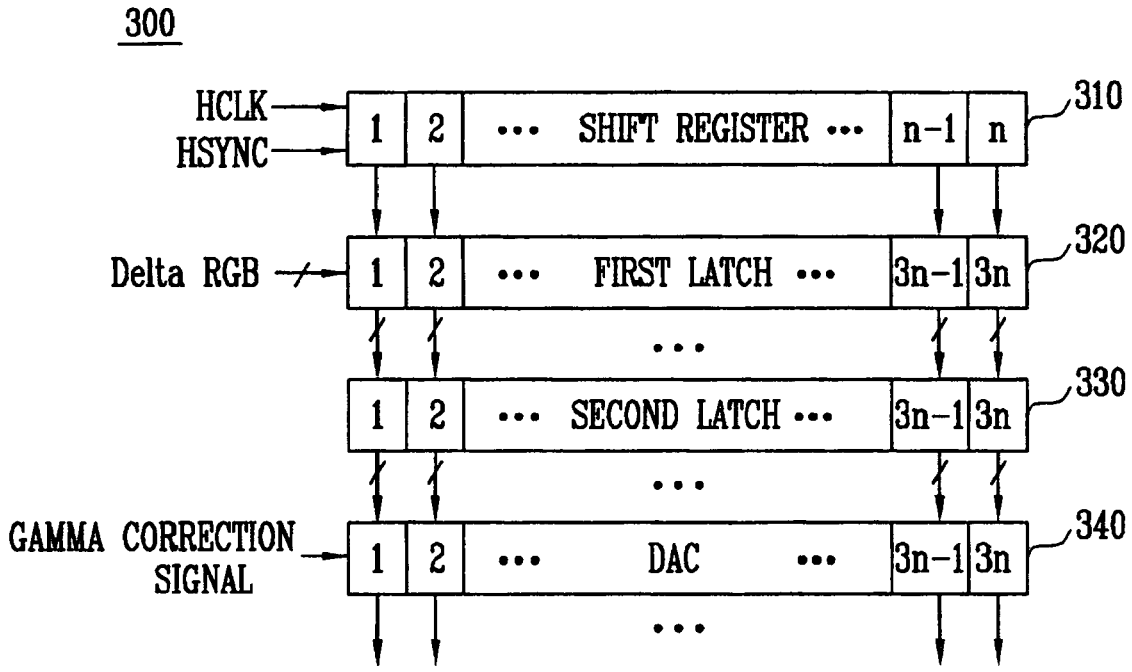
FIG. 5 is a view of a data driver of the delta-structured display device of FIG. 3.

In addition, the data driver 300 can perform processing such as gamma correction and D/A conversion in order to convert the delta video signals into the data signals that are suitable for the image display portion. For example, as illustrated in FIG. 5, the data driver 300 can include a shift register 310, a first latch 320, a second latch 330, and a D/A converter (DAC) 340. The data driver 300 can include a plurality of shift registers 310 or a plurality of DAC 340 in order to process the delta video signals and the R, G, and B signals, respectively.

The shift register 310 respectively provides first and second latch enable signals for sequentially storing delta video signals (Delta RGB) in the first latch 320 and transferring them to the second latch 330 according to a clock signal HCLK and a horizontal sync signal HSYNC. Further, the first latch 320 sequentially stores the delta video signals in response to the first latch enable signal, and the second latch 330 receives the delta video signals of one horizontal line from first latch 320 according to the second enable signal of the shift register 310. Further, the DAC 340 coverts the delta video signals of one horizontal line transferred from the first latch 320 into data signals, and transmits the data signals to the image display portion 100.

Referring back to FIG. 3, the controller 500 controls the scan driver 200 and the data driver 300 by generating a control signal and a clock signal. In addition, the controller 500 rearranges the video signals RGB into the delta video signals (Delta RGB), and stores the delta video signals into the memory 540, and then supplies the delta video signals of one horizontal line to the data driver 300. In order to do this, the controller 500 includes an interface 510, a timing controller 520, a video signal converter 530, and a memory 540.

The interface 510 receives signals by converting analog video signals input from an external source into digital video signals. On the other hand, the interface 510 can receive the digital video signals input from an external source. In addition, the interface 510 can be implemented with a low-voltage differential signaling (LVDS) interface that uses 3.3V or 1.5V that is lower than the standard 5V voltage typically used in the display device, as an electrical connection between, for example, the controller 500 and the host device (not illustrated) such as a motherboard to which the controller 500 is connected.

The timing controller 520 generates a clock signal and a control signal. Here, the control signal includes a vertical sync signal, a horizontal sync signal, and a start signal, etc. The timing controller 520 supplies the clock signal and the control signal to the video signal converter 530, the scan driver 200, and the data driver 300.

The video signal converter 530 sequentially receives the first line video signals RGB, and the second line video signals RGB, according to the clock signal from the timing controller 520. Here, the first and second line video signals include a plurality of video signals, and each video signal includes a red sub video signal, a green sub video signal, and a blue sub video signal.

The video signal converter 530 also extracts the first sub video signals from any one of the red, green, and blue sub video signals of the even signals in the first line video signals, alternately or sequentially for storage of the first sub video signals into the memory 540. Here, the first sub-video signals stored in the memory 540 form the first line delta video signals.

In addition, the video signal converter 530 extracts the second sub video signals from any one of the red, green, and blue sub video signals of the odd signals in the second line video signals following the first line video signal, alternately or sequentially for storage of the second sub video signals into the memory 540. Here, the second sub-video signals stored in the memory 540 form the second line delta video signals.

The video signal converter 530 also sequentially stores the first line delta video signals and the second line delta video signals into the memory 540 and sequentially reads them and provides them to the data driver 300. The video signal converter 530 is preferably implemented as a programmable logic chip 550 such as a field programmable gate array (FPGA).

The memory 540 is provided as a memory having a capacity where the video signals supplied to at least one horizontal line can be stored. In addition, the memory 540 can have a capacity where the video signals supplied to at least two horizontal lines can be stored to facilitate processing of the video signal. In this case, first, the memory 540 stores the first line delta video signals supplied to the first horizontal lines of the delta structure, and then reads the first line delta video signals while recording the second line delta video signals supplied to the second horizontal lines adjacent to the first horizontal lines at the same time.

In addition, when the memory 540 is provided as a programmable logic chip 550 such as the FPGA, it can be formed within the logic chip 550 along with the video signal converter 530. In this case, the memory 540 can be formed as a line memory having a storage capacity of at least horizontal line. In addition, the memory 540 can be implemented as a random access memory (RAM), a read only memory (ROM), and a video memory such as an additional high-speed memory.

Figure 6:
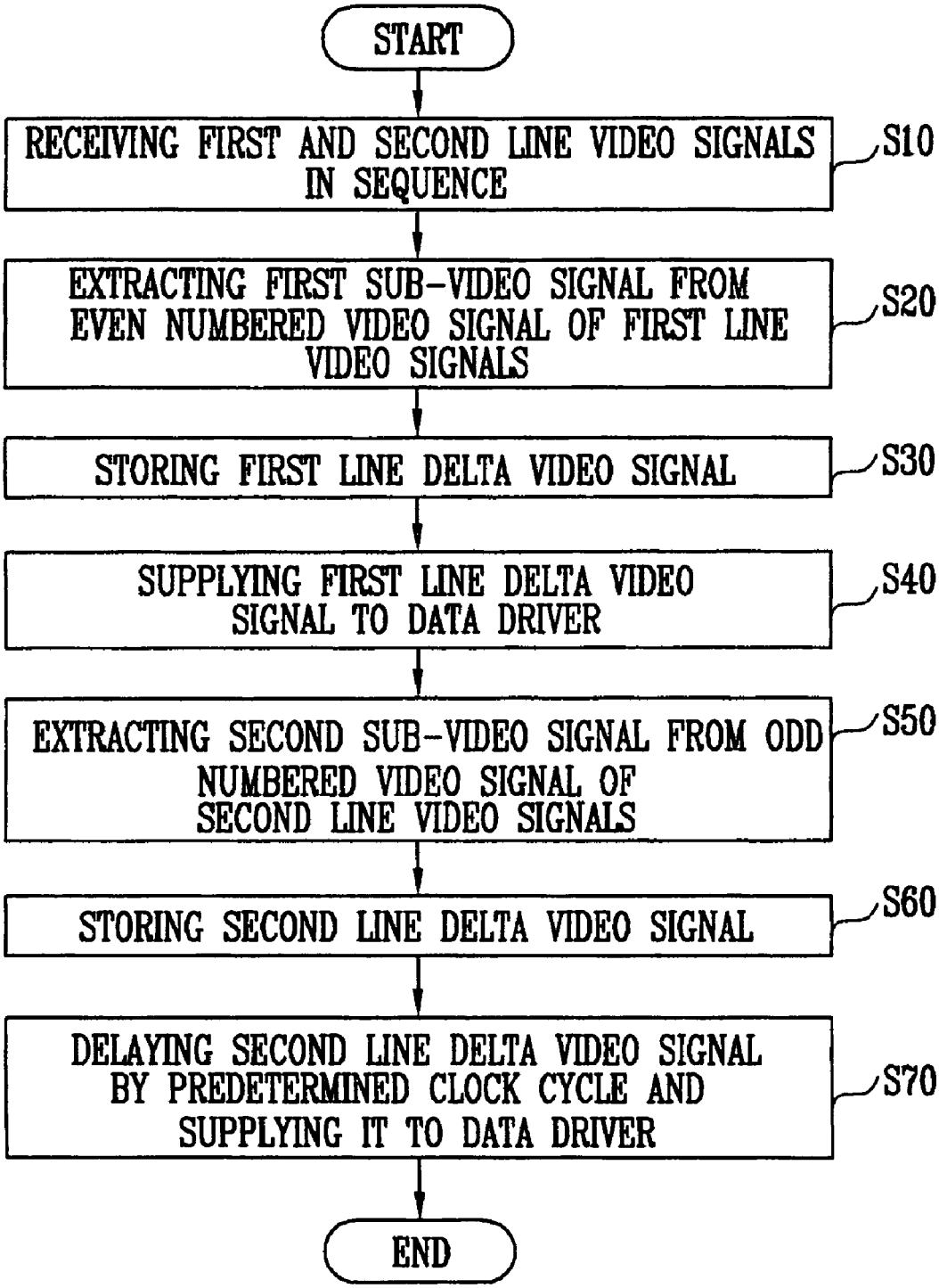
FIG. 6 is a view of a flow chart illustrating a video signal processing method employed in a delta-structured display device according to an embodiment of the present invention.
Figure 7:
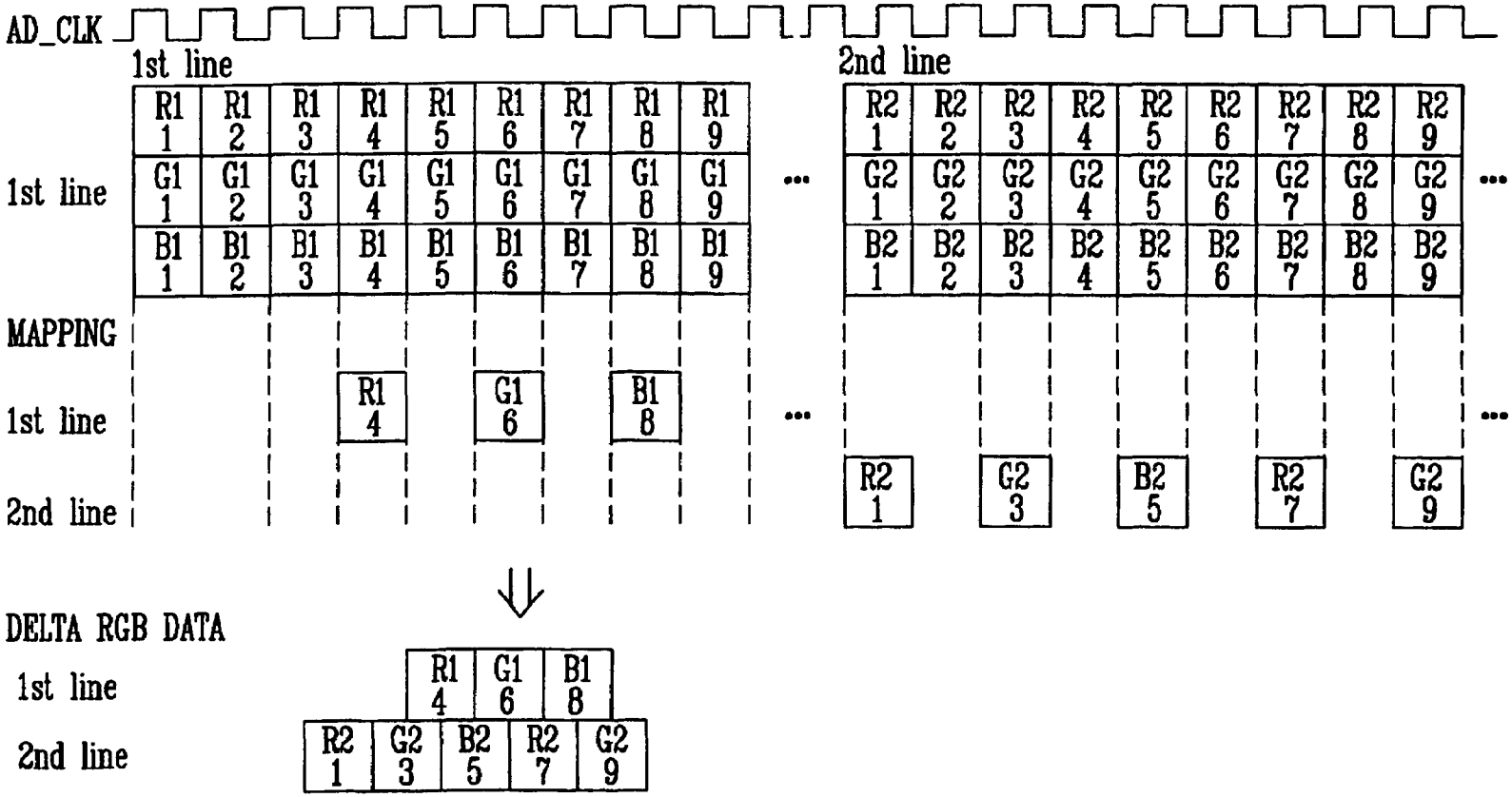
FIG. 7 is a view of rearrangement of a video signals according to a delta structure in the delta-structured display device according to an embodiment of the present invention.

In the following description, a video signal processing method in the controller 500, and in the video signal converter 530 of the controller 500 will be described in detail in conjunction with FIGS. 6 and 7. Turning now to FIG. 6, FIG. 6 is a view of a flow chart of a video signal processing method employed in the delta-structured display device according to an embodiment of the present invention. FIG. 7 is a view used to explain the step of rearranging the video signals in the delta-structured display device according to an embodiment of the present invention.

Referring to FIGS. 6 and 7, first, the controller sequentially receives the video signals (RGB Data), including the first line video signals and the second line video signals (S10). Here, the first line video signals refer to video signals transferred in the first horizontal lines or one horizontal line of the image display portion having a delta structure, and the second line video signals refer to video signals transferred in the second horizontal lines or another horizontal line adjacent to the first horizontal line. Further, each video signal in the first and second line video signals includes a red sub video signal Rn (where n is a natural number), a green sub video signal Gn, and a blue sub video signal Bn.

The controller then sequentially extracts the first sub video signals R1_4, G1_6, and B1_8 of any one of the red, green, and blue sub video signals between at least two successive video signals from the first line video signals, according to a clock signal AD_CLK (S20). Here, the video signals to be transferred to the first horizontal lines are rearranged or mapped to correspond to the first line of the delta structure. The controller then stores the first sub video signals as the first line delta video signals R1_4, G1_6, and B1_8 to be transferred to the first horizontal lines (S30). Next, the controller supplies the first line delta video signals stored in the memory to the data driver (S40).

The controller then sequentially extracts the second sub video signals R2_1, G2_3, B2_5, R2_7, and G2_9 of any one of the red, green, and blue sub video signals between at least two successive video signals from the second line video signals, according to the clock signal AD_CLK (S50). Here, the video signals to be transferred to the second horizontal lines are mapped to correspond to the second line of the delta structure. The controller then stores the second sub video signals as the second line delta video signals R2_1, G2_3, B2_5, R2_7, and G2_9 to be transferred to the second horizontal lines (S60).

The controller then supplies the second line delta video signals stored in the memory to the data driver (S70). Here, the controller supplies the second line delta video signals by delaying them as much as the predetermined clock cycle so that a start position of the second delta video signals are matched to a start position of the first line delta video signals. For example, unlike the stripe pixel structure display device, the delta-structured display device has a difference of 3 clock cycles with respect to the pixel that displays the same color. Therefore, for the delta-structured display device that supplies the same color to the same data line, when the video signals are actually mapped, the second sub video signal of the first one of the even signals are delayed as much as 3 clock cycles to allow the second sub video signal to be input to the data line to which the first sub video signal of the first one of the odd signal.

Further, the first line delta video signals and the second line delta video signals described above are alternately extracted from the respective line video signals input sequentially and mapped. In addition, the first line delta video signals and the second line delta video signals described above can be extracted from the even signals of the first line video signals and the odd signals of the second line video signals, respectively.

Further, when the memory has a storage capacity of more than two horizontal lines, the controller can use the memory in a manner that the controller records the subsequent delta video signals while storing the delta video signals of more than two horizontal lines into the memory or reading one delta video signal.

In addition, the first and second delta video signals described above can be formed such that the first and second sub video signals of the red R, green G, and blue B are sequentially extracted in a different order such as B, G, R instead of the order R, G, B.

Figure 8:
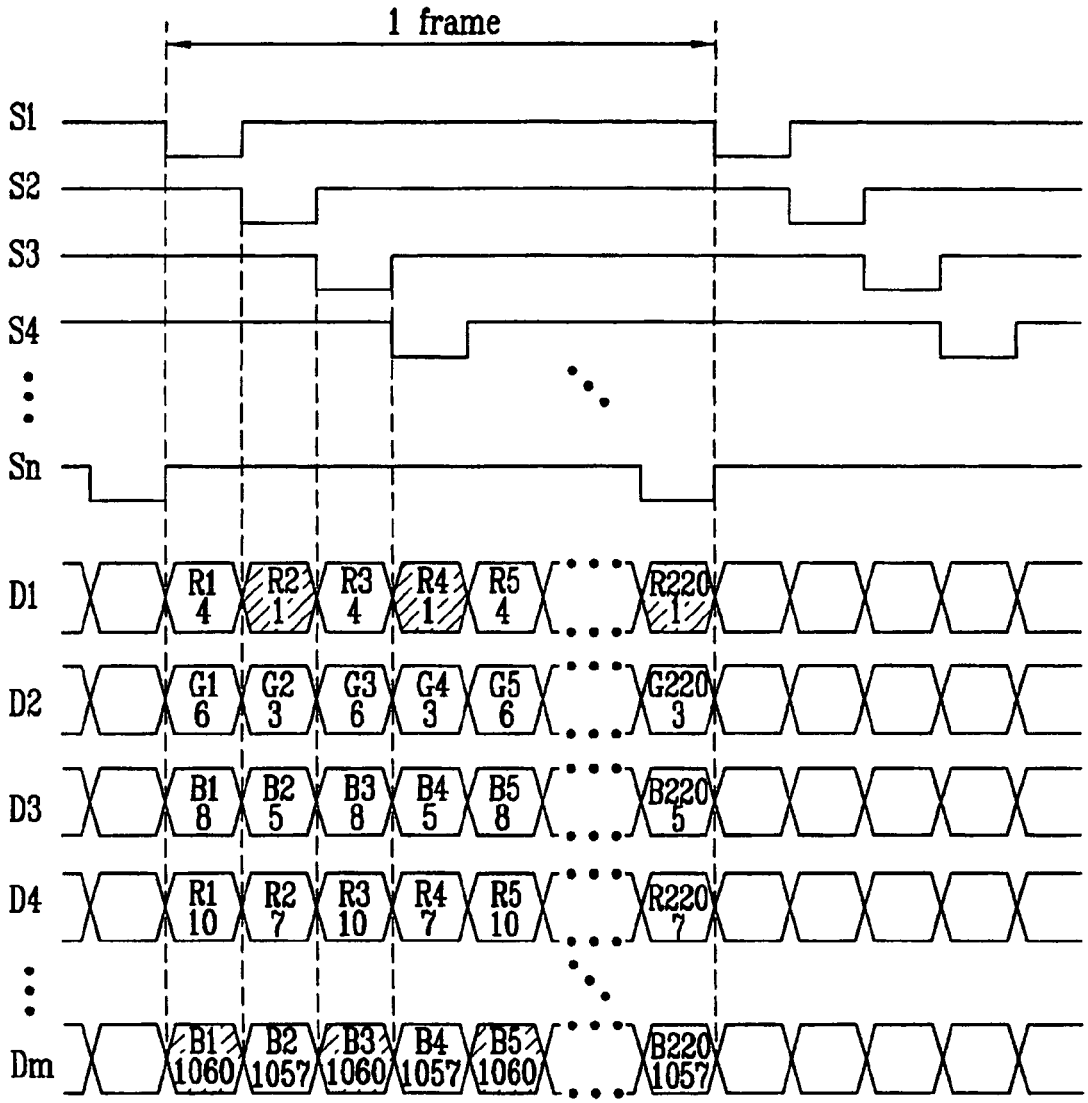
FIG. 8 is a view of a drive timing diagram for a delta-structured display device according to an embodiment of the present invention.
Figure 9:
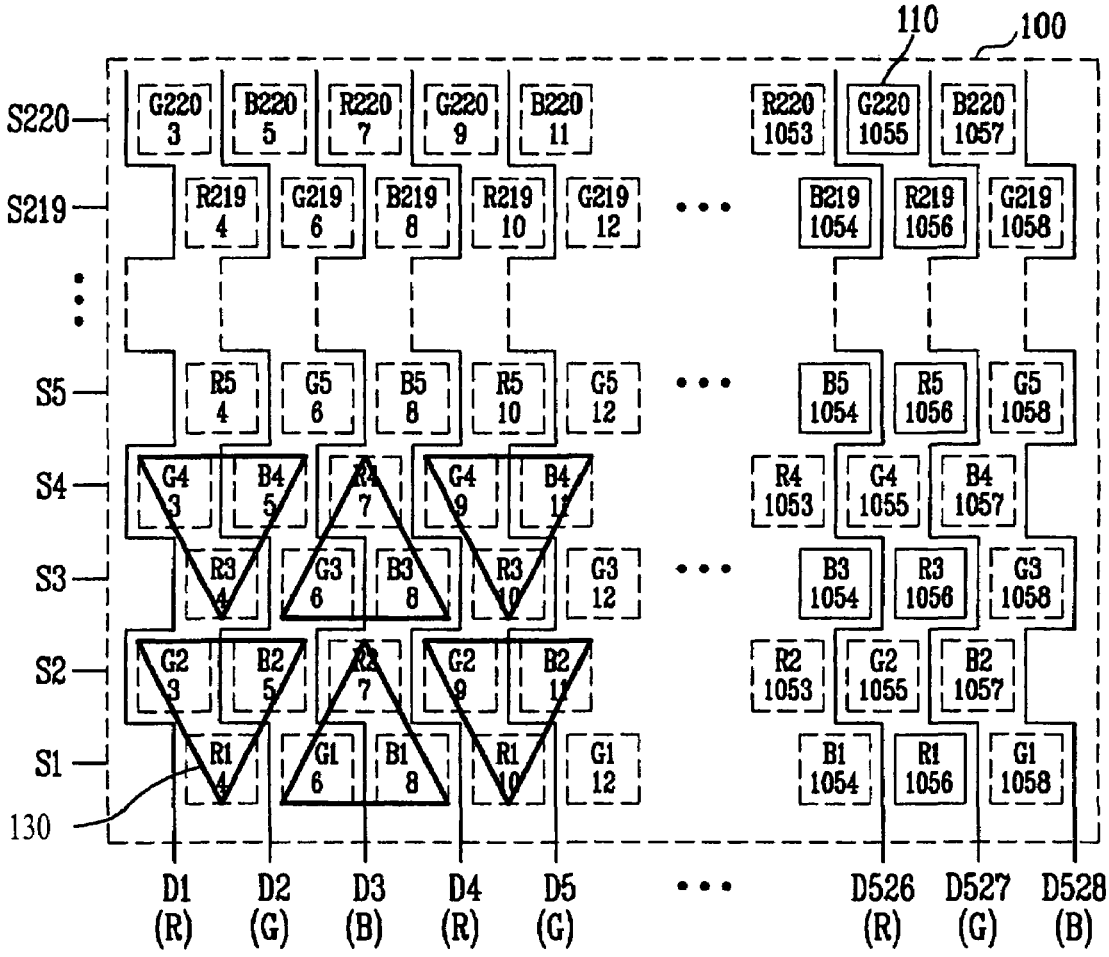
FIG. 9 is a view of a video signals transmitted to each pixel in a delta-structured display device according to an embodiment of the present invention.

Delta images displayed in the delta structure image display portion will now be described with reference to FIGS. 8 and 9. Turning now to FIGS. 8 and 9, FIG. 8 is a view of a drive timing diagram for the delta-structured display device according to an embodiment of the present invention and FIG. 9 is a view of video signals transferred to the respective pixels within the image display portion of the delta-structured display device according to an embodiment of the present invention. In FIG. 9, the image display portion has 220 scanning lines and 528 data lines for each RGB. Thus, in FIG. 8, Sn and Dm can be S220 and D528, respectively.

Referring to FIGS. 8 and 9, when low level scanning signals are sequentially applied to a plurality of scanning lines S1, S2, S3, S4, . . . , and S220 in one frame period in the delta-structured display device, the delta video signals are sequentially supplied to a plurality of data lines D1, D2, D3, D4, . . . , and D528 for one horizontal line period where the scanning signals are applied.

In the delta structure image display portion 100, the delta pixel 130 includes one or two pixels 110 connected to the first line and two or one pixels 110 connected to the second line. In this embodiment, the first line of the delta pixel 130 becomes the odd scanning lines S1, S3, S5, . . . , and S219, and the second line thereof becomes the even scanning lines S2, S4, . . . , and S220.

Further, the delta video signals supplied from the controller to the data driver are D/A converted or gamma corrected before being transmitted to the image display portion 100. In this case, the delta video signals are converted into the corresponding data signals and supplied from the data driver to the respective data lines.

The delta video signals slashed in FIG. 8 (i.e., the data signals R2_1, R4_1, . . . , R220_1 of FIG. 8) as well as B1_1060, B3_1060, B5_1060, . . . , B219_1060 (not illustrated) refer to dummy signals not substantially indicated on the image display portion 100 illustrated in FIG. 9. Further, in each data line D1, D2, D3, D4, D5, . . . , D526, D527, and D528 of FIG. 9, the delta video signals displaying the same color of any one of the red R, green G, and the blue B delta video signals are sequentially supplied for the horizontal period where each scanning signal is applied. By doing so according to the present invention, the delta-structured display device without a need of a driver IC and/or a frame memory can be readily implemented.

Figure 10:
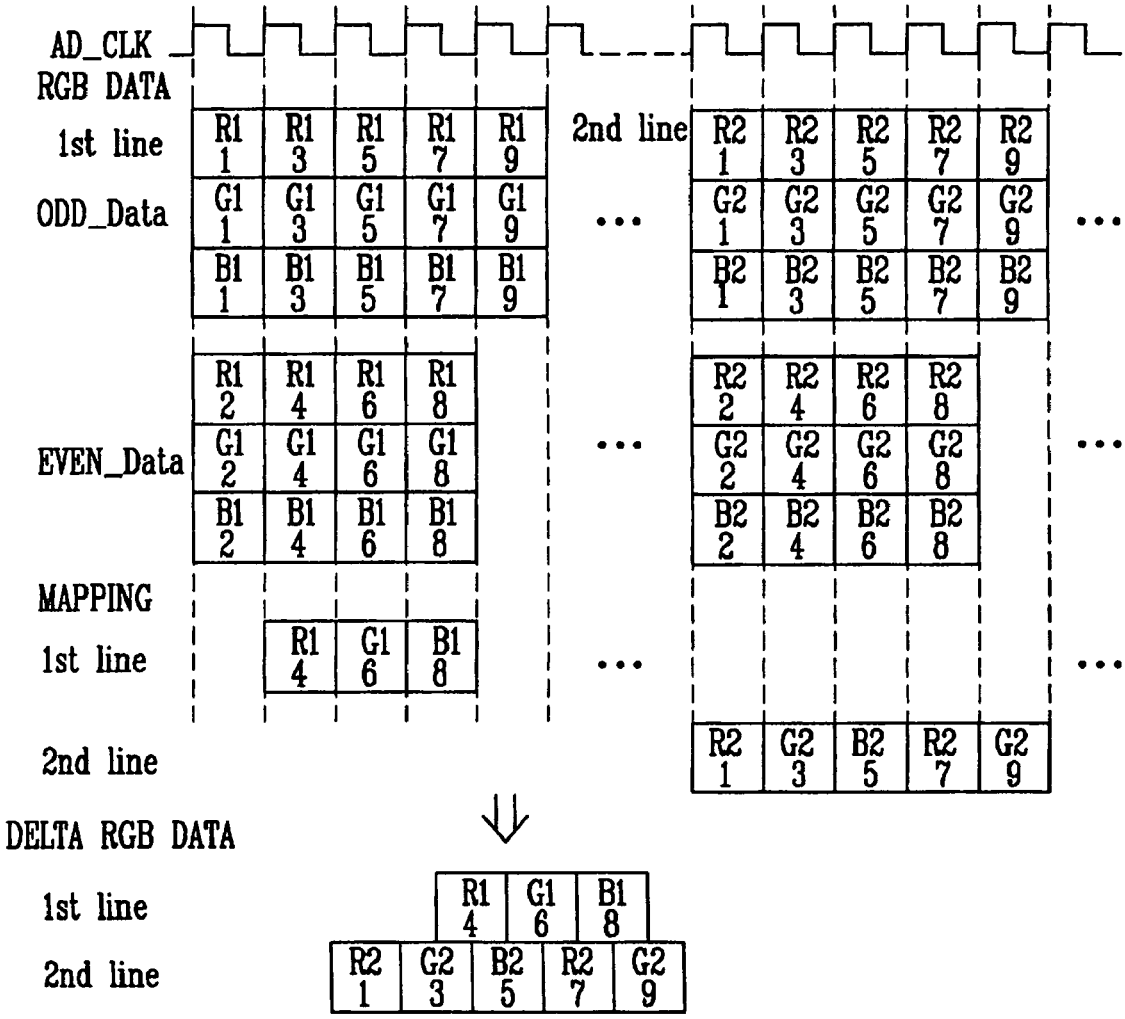
FIG. 10 is a view of a video signal processing method where the signal is transmitted to a delta-structured display device through an LVDS interface according to an embodiment of the present invention.

Turning now to FIG. 10, FIG. 10 is a view of a method of processing video signals transferred through an LVDS interface in the delta-structured display device according to an embodiment of the present invention. The embodiment of FIG. 10 is substantially the same as the embodiment illustrated in FIG. 7 except for the LVDS interface. Therefore, portions of the description that overlap that of FIG. 7 are omitted.

Referring to FIGS. 3 and 10, when the interface 510 in the controller 500 is implemented as an LVDS interface, the delta-structured display device according to an embodiment of the present invention receives the first and second line video signals divided as the odd signals and the even signals and are sequentially input. Further, the controller 500 extracts the first line delta video signals from the first line video signals divided and input as the odd signals and the even signals, and extracts the second line delta video signals from the second line video signals divided and input as the odd signals and the even signals, and stores the extracted signals into the memory 540 sequentially.

For example, the first line delta video signals R1_4, G1_6, and B1_8 are extracted from the even signals of the first line video signals, and the second line delta video signals R2_1, G2_3, B2_5, R2_7, and G2_9 are extracted from the odd signals of the second line video signals.

Next, for example, since the start positions of the first and second line delta video signals have one and one half clock cycle difference viewing from the delta structure layout, the controller 500 supplies the second line delta video signals to the data driver 300 by delaying them as much as one and one half clock cycles, when the second delta video signal is supplied to the data driver 300.

Like this, when the delta-structured display device according to an embodiment of the present invention uses an LVDS interface, the image data can be processed more effectively. In addition, in the delta-structured display device according to an embodiment of the present invention, even when the screen display direction is inverted to the top and bottom and left and right, the image data can be processed much more easily.

Figure 11:
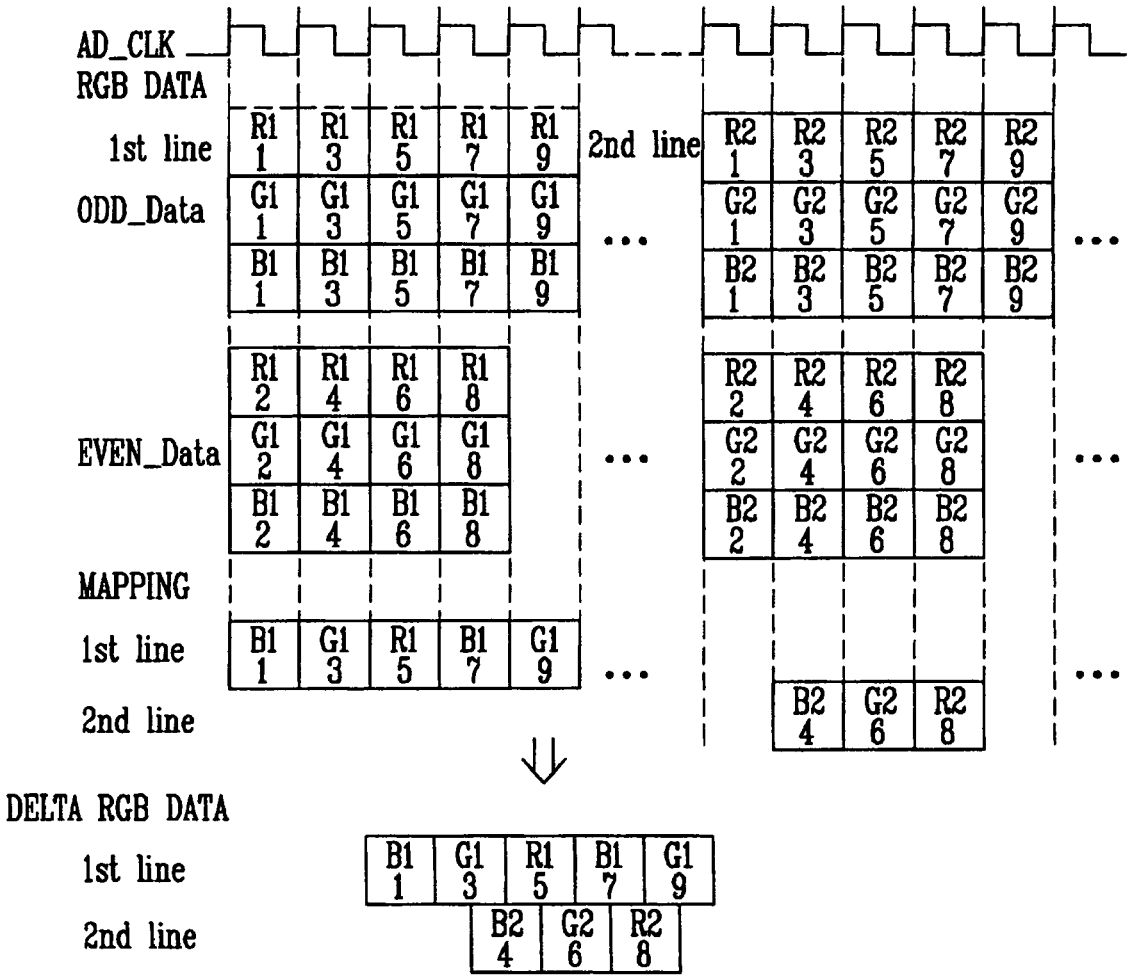
FIGS. 11 through 13 are views of video signal processing methods when a screen display direction is inverted in the delta-structured display device according to other embodiments of the present invention.
Figure 12:
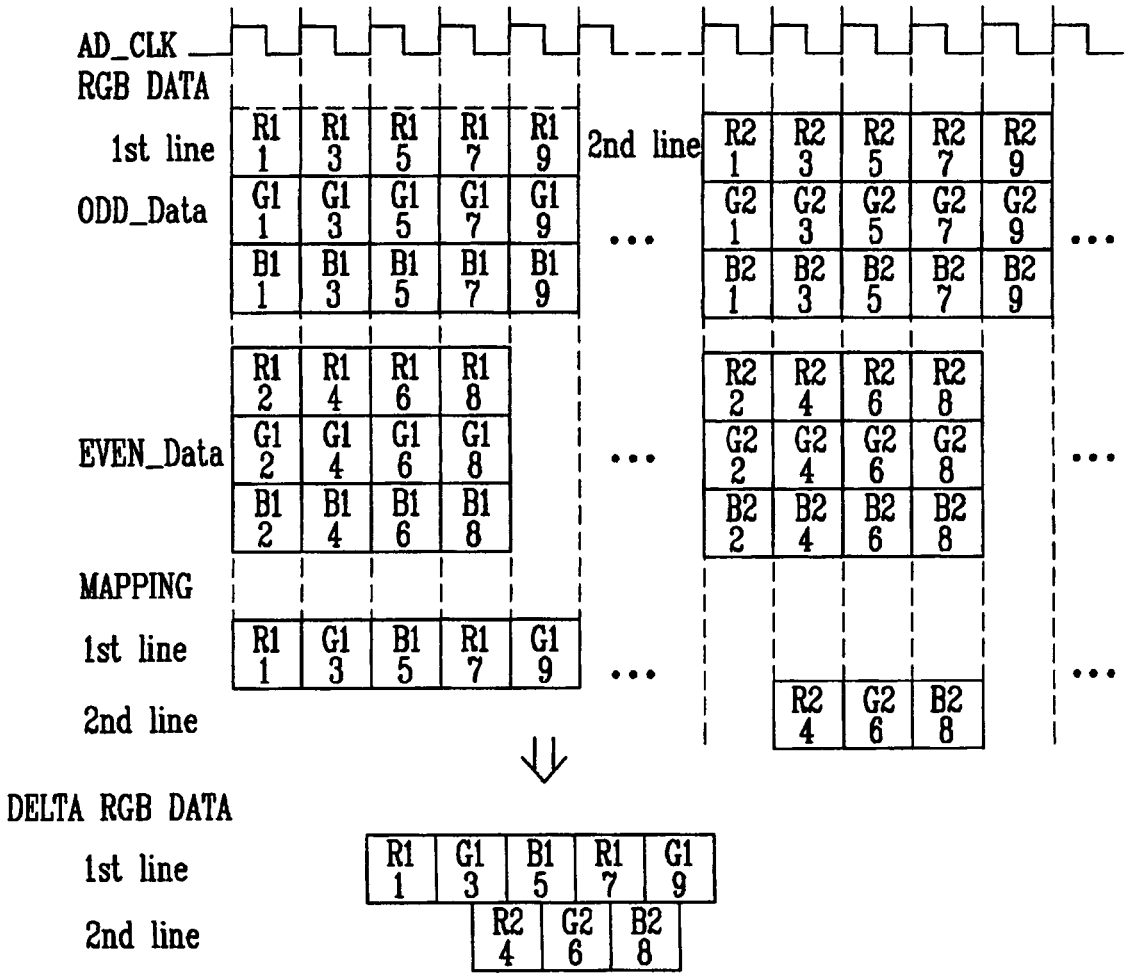
Figure 13:
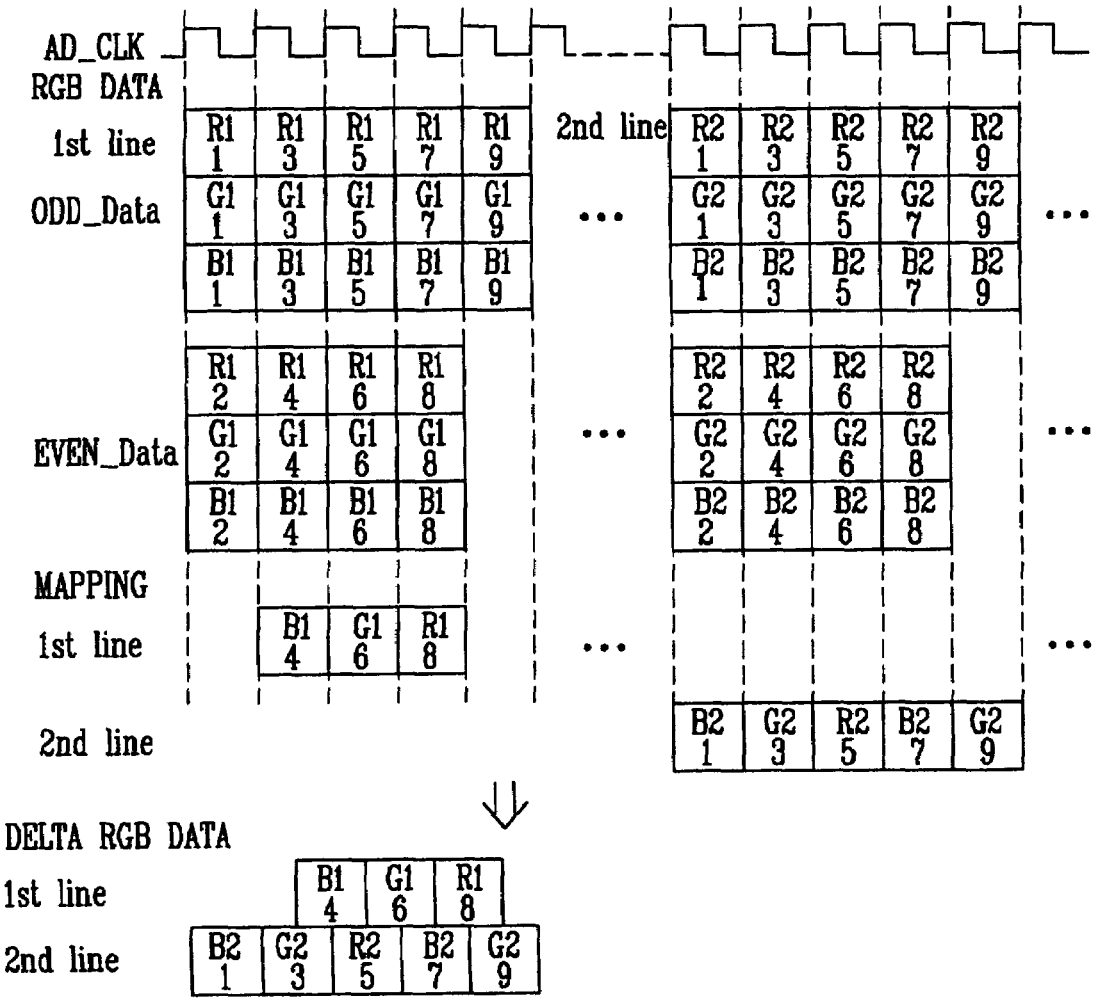

A method of processing video signals when the screen display direction is inverted in the delta-structured display device will now be described in conjunction with FIGS. 11 through 13. FIGS. 11 through 13 are views of a video signal processing methods when a screen display direction is inverted in the delta-structured display device according to embodiments of the present invention.

Turning now to FIG. 11, FIG. 11 is a view of a video signal processing method according to another embodiment of the present invention for a case where the direction where the scanning signals are applied in a shift register (not illustrated) within the scan driver of the delta-structured display device is inverted. In other words, the embodiment of FIG. 11 is directed to a case where, when the scanning signals are sequentially provided in the first direction from the shift register (not illustrated) of the scan driver corresponding to the video signal processing method of FIG. 10, the scanning signals are sequentially provided in the second direction opposite to the first direction.

For the embodiment of FIG. 11, the delta-structured display device having the LVDS interface according to the present invention sequentially extracts the first line delta video signals B1_1, G1_3, R1_5, B1_7, and G1_9 from the odd signals of the input first line video signals and stores the extracted first line delta video signals into the memory as signals to be supplied to the first line of the delta structure, and extracts the second line delta video signals B2_4, G2_6, and R2_8 from the even signals of the input second line video signals following the first line video signals and stores these extracted signals the memory as signals to be supplied to the second line adjacent to the first line of the delta structure. Next, the first and second line delta video signals are transferred to the image display portion through the data driver to display the images with the screen direction upside down. With the arrangement described above, the delta-structured display device according to the embodiment of FIG. 11 readily inverts the screen display direction between top and bottom while displaying the delta video signals on the image display portion.

Turning now to FIG. 12, FIG. 12 is a view of a video signal processing method for an embodiment where the direction where the data signals are applied from the shift register (not illustrated) within the data driver is inverted. In other words, the embodiment of FIG. 12 is directed to a case where, when the data signals are provided in the third direction from the shift register (not illustrated) of the data driver corresponding to the video signal processing method of FIG. 10, the data signals are sequentially provided in the fourth direction opposite to the third direction.

For the above embodiment of FIG. 12, the delta-structured display device having the LVDS interface according to FIG. 12 sequentially extracts the first line delta video signals R1_1, G1_3, B1_5, R1_7 and G1_9 from the odd signals of the input first line video signals and stores the extracted first line delta video signals into the memory as signals to be supplied to the first line of the delta structure, and sequentially extracts the second line delta video signals R2_4, G2_6, and B2_8 from the even signals of the input second line video signals following the first line video signals and stores these extracted signals into the memory as signals to be supplied to the second line adjacent to the first line of the delta structure. Next, the first and second line delta video signals are transferred to the image display portion through the data driver to display the images with the screen direction left side to the right. With the arrangement described in conjunction with FIG. 12, the delta-structured display device according to FIG. 12 readily inverts the screen display direction between left and right while displaying the delta video signals on the image display portion.

Turning now to FIG. 13, FIG. 13 is a view of a video signal processing method where the direction that the scanning signals are applied in a shift register (not illustrated) within the scan driver of the delta-structured display device is inverted and the direction where the data signals are applied from the shift register (not illustrated) within the data driver is also inverted. In other words, the embodiment of FIG. 13 is directed to where, when the scanning signals are sequentially provided in the first direction from the shift register (not illustrated) of the scan driver, and when the data signals are provided in the third direction from the shift register (not illustrated) of the data driver corresponding to the video signal processing method of FIG. 10, the data signals are sequentially provided in the second direction opposite to the first direction and in the fourth direction opposite to the third direction.

For the embodiment of FIG. 13, the delta-structured display device having the LVDS interface sequentially extracts the first line delta video signals B1_4, G1_6, and R1_8 from the odd signals of the input first line video signals and stores the extracted first line delta video signals into the memory as signals to be supplied to the first line of the delta structure, and sequentially extracts the second line delta video signals B2_1, G2_3, R2_5, B2_7, and G2_9 from the even signals of the input second line video signals following the first line video signals and stores these extracted signals into the memory as signals to be supplied to the second line adjacent to the first line of the delta structure. The first and second line delta video signals are then transferred to the image display portion through the data driver to display the images with the screen direction upside down and left side to the right. With the arrangement described in conjunction with FIG. 13, the delta-structured display device readily inverts the screen display direction between top and bottom and left and right while displaying the delta video signals on the image display portion.

In the embodiments described herein, the pixel circuit is an essential pixel circuit in a voltage-writing scheme including the drive transistor M1 and the switching transistor M2. However, the embodiments of the present invention can also be applied to a pixel circuit in a voltage-writing scheme including a transistor for compensating a threshold voltage of the drive transistor and a transistor for compensating a voltage drop other than the switching transistor and the drive transistor. Moreover, the embodiments of the present invention can be applied to a pixel circuit in a current writing scheme where data signals are supplied as data currents, as well as the pixel circuit in the voltage-writing scheme.

In addition, while the above embodiments have been described with reference to a transistor of the pixel circuit having a source, a drain, and a gate, each transistor can be arranged with a first electrode indicating a source or a drain, a second electrode indicating a drain or a source, and a gate. In other words, the MOS transistor in the pixel circuit described above is just illustrative. Therefore, the pixel circuit of the present invention can include other types of transistors besides MOS transistors. For example, the transistor can be implemented as including a first electrode, a second electrode, and a third electrode, and as an active device where a current amount flowing from the second electrode to the third electrode can be controlled by a voltage applied between the first and second electrodes.

In addition, according to the embodiments described above, the second transistor M2 of the pixel circuit is a device for switching electrodes at both sides in response to the scanning signal, and can also be implemented with various switching devices capable of performing the same function.

In addition, according to the embodiments described above, the LEDs can be formed with an electroluminescent device (EL) that can be an inorganic EL device formed with an emission layer with inorganic matter as well as an organic EL device formed with organic matter.

In addition, according to the embodiments described above, the scan driver and the data driver of the display device can be directly mounted on a glass substrate on which the image display portion is formed, and can be replaced with a drive circuit where scanning lines, data lines, and the transistor are is formed coplanar on the substrate having the image display portion thereon. On the other hand, the scan driver and/or the data driver can be provided in a chip on flexible board or a chip on film (COF). In other words, the scan driver and/or the data driver can be mounted as a flexible printed circuit (FPC) or a film attached and electrically connected to the substrate.

According to the present invention, the data driver in the driver IC adapted to the delta-structured display device can be maximized. In addition, the delta-structured display device on which the high-speed operation device is not mounted can appropriately display delta images. Further, a small electronic apparatus mounted with the delta-structured display device for displaying more natural curve or moving picture can be provided at a lower cost.

Although a few embodiments of the present invention have been illustrated and described, it would be appreciated by those skilled in the art that changes might be made in this embodiment without departing from the principles and spirit of the invention, the scope of which is defined in the claims and their equivalents.

What is claimed is:

1. A method, comprising:

receiving sequentially first line video signals and second line video signals, each video signal having a plurality of sub data signals that comprise a red sub video signal, a green sub video signal and a blue sub video signal;

extracting alternately one of the red sub video signals, the green sub video signals, and the blue sub video signals for at least two successive video signals of the first line video signals and storing the extracted signals into a memory as first line delta video signals;

extracting alternately one of the red sub video signals, the green sub video signals, and the blue sub video signals for at least two successive video signals of the second line video signals and storing the extracted signals into the memory as second line delta video signals; and sequentially providing the first line delta video signals and the second line delta video signals to a data driving portion, wherein said first and second line delta video signals comprise a plurality of delta pixels, each of said delta pixels is comprised of signals from two separate and successive horizontal lines of received video signals.

2. The method of claim 1, wherein storing the extracted first line delta video signals into the memory comprises reading the extracted first line delta video signals from the memory followed by storing the extracted first line delta video signals into the memory.

3. The method of claim 1, wherein storing the extracted second line delta video signals into the memory comprises reading the extracted first line delta video signals from a first region of the memory and recording the extracted first line delta video signals into a second region of the memory.

4. The method of claim 1, wherein the memory comprises a line memory having a storage capacity of at least one horizontal line.

5. The method of claim 1, wherein sequentially providing the first line delta video signals and the second line delta video signals to the data driver portion comprises delaying by a predetermined clock cycle the second line delta video signals preceded by the predetermined clock cycle to the first line delta video signals such that a start position of the second line delta video signals is aligned to a start position of the first line delta video signals when providing the first line delta video signals and the second line delta video signals to the data driver portion.

6. The method of claim 1, further comprising digital to analog (D/A) converting the first line delta video signals and the second line delta video signals into first data signals and second data signals respectively.

7. The method of claim 1, further comprising:

providing the first line delta video signals to a data line in an image display portion during a first horizontal period where first scanning signals are applied to a first scanning line; and providing the second line delta video signals to the data line during a second horizontal period that follows the first horizontal period where second scanning signals are applied to a second scanning line.

8. The method of claim 1, further comprising providing the first line delta video signals and the second line delta video signals to a first horizontal line and a second horizontal line, respectively, in a delta-structure pixel array where at least one first sub-pixel arranged in the first horizontal line of an image display portion and at least one second sub-pixel arranged in the second horizontal line adjacent to the first horizontal line comprise one pixel.

9. The method of claim 1, wherein receiving sequentially the first and second line video signals comprises receiving sequentially odd signals and even signals of the first line video signals and odd signals and even signals of the second line video signals, respectively, in parallel.

10. The method of claim 1, wherein extracting the first and second line delta video signals comprises extracting the first and second line delta video signals from even signals of the first line video signals and odd signals of the second line video signals, respectively.

11. The method of claim 10, wherein extracting the first and second line delta video signals comprises extracting the first and second line delta video signals by inverting an order of extracting the odd signals and the even signals, based on a direction of shifting signals by a shift register in a scan driver.

12. The method of claim 10, wherein extracting the first and second line delta video signals comprises extracting the first and second line delta video signals by inverting an order of extracting the red sub video signal, the green sub video signal, and the blue sub video signal from the odd signals of the first line video signals and the even signals of the second line video signals, based on a data signal applying direction between a first direction extending in a scanning direction and a second direction opposite to the first direction.

13. A display device, comprising:

a scan driver adapted to supply scanning signals to a plurality of scanning lines;

a data driver adapted to supply data signals to a plurality of data lines;

a plurality of pixels arranged in deltas, each pixel comprises a light emitting diode electrically connected to one of the scanning lines and one of the data lines; and a controller adapted to control the scanning signals and the data signals supplied to the plurality of pixels, wherein the controller is also adapted to sequentially receive first line video signals and second line video signals, each having a plurality of video signals having red sub video signals, green sub video signals, and blue sub video signals, extracting alternately one of the red sub video signals, the green sub video signals, and the blue sub video signals for at least two video signals of the first line video signals and storing the extracted signals into a memory as first line delta video signals, extracting alternately one of the red sub video signals, the green sub video signals, and the blue sub video signals for at least two video signals of the second line video signals and storing the extracted signals into a memory as second line delta video signals, and supplying sequentially the first line delta video signals and the second line delta video signals to the data driver, wherein said first and second line delta video signals comprise a plurality of said deltas, each of said deltas is comprised of ones of said plurality of video signals from two separate and successive horizontal lines of received video signals.

14. The display device of claim 13, the controller being further adapted to supply the second line delta image to the data driver by delaying by a predetermined clock cycle the second line delta video signals preceded by the predetermined clock cycle to the first line delta video signals such that a start position of the second line delta video signals is aligned to a start position of the first line delta video signals.

15. The display device of claim 13, wherein the controller comprises a memory that includes a storage capacity of one horizontal line adapted to sequentially store the first line delta video signals and the second line delta video signals.

16. The display device of claim 13, wherein the controller comprises a memory adapted to allow the first line delta video signals and the second line delta video signals to be read therefrom and written thereto.

17. The display device of claim 13, wherein the memory comprises a line memory having a storage capacity of at least one horizontal line.

18. The display device of claim 13, wherein the controller comprises a video signal converter adapted to rearrange the first and second line video signals into the first and second delta video signals.

19. The display device of claim 13, wherein the controller comprises a timing controller adapted to supply a sync signal and a control signal.

20. The display device of claim 13, the data driver being adapted to supply the plurality of data lines with first data signals that correspond to the first line delta video signals for a first horizontal period when first scanning signals are applied to first scanning lines, the data driver being further adapted to supply the plurality of data lines with second data signals corresponding to the second line delta video signals for a second horizontal period when second scanning signals are applied to second scanning lines.

21. The display device of claim 20, wherein the data driver comprises a digital to analog (D/A) converter adapted to D/A convert the first and second line delta video signals into the first and second data signals.

22. The display device of claim 13, wherein the controller comprises a low voltage differential signal (LVDS) interface adapted to receive odd signals and even signals of the first line video signals and odd signals and even signals of the second line video signals, respectively, in parallel.

23. The display device of claim 13, the controller being further adapted to extract the first and second line delta video signals from odd signals of the first line video signals and even signals of the second line video signals.

24. The display device of claim 23, the controller being further adapted to extract the first and second line delta video signals by inverting an order of extracting the odd signals and the even signals, based on a direction of shifting signals by a shift register in the scan driver such that phases of both the first horizontal line to which first data signals corresponding to the first line delta video signals are transmitted and second horizontal line to which second data signals corresponding to the second line delta video signals are determined.

25. The display device of claim 23, the controller being further adapted to extract the first and second line delta video signals by inverting an order of extracting the red sub video signal, the green sub video signal, and the blue sub video signals from the odd signals of the first line video signals and the even signals of the second line video signals, based on a data signal applying direction between a first direction extending in a scanning direction and a second direction opposite to the first direction.

26. The display device of claim 13, each light emitting diode comprises a first electrode and a second electrode, the second electrode being connected to a first power line, each pixel further comprising:

a first transistor that comprises a first electrode, a second electrode and a gate, the first electrode being connected to a second power line and the second electrode being connected to the first electrode of the light emitting diode;

a second transistor that comprises a first electrode, a second electrode, and a gate, the first electrode being connected to the one of the data lines, the second electrode being connected to the gate of the first transistor, and the gate being connected to the one of the scanning lines; and a capacitor that comprises a first electrode and a second electrode, the first electrode being connected to the first electrode of the first transistor and the second electrode being connected to the gate of the first transistor.

27. The display device of claim 13, each light emitting diode comprises an organic light emitting diode that includes an organic matter adapted to be an emission layer.

28. The display device of claim 13, each pixel comprises only one of the scanning lines and only one of the data lines.

* * * * *